US010435261B2

(12) United States Patent
Miyajima et al.

(10) Patent No.: US 10,435,261 B2
(45) Date of Patent: Oct. 8, 2019

(54) SHEET CONVEYING APPARATUS AND IMAGE FORMING APPARATUS

(71) Applicant: Konica Minolta, Inc., Chiyoda-ku, Tokyo (JP)

(72) Inventors: Satoshi Miyajima, Hino (JP); Takanobu Shiki, Sagamihara (JP); Tadayuki Ueda, Kokubunji (JP); Hiroshi Oyama, Hino (JP); Remi Ishikawa, Mitaka (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/972,580

(22) Filed: May 7, 2018

(65) Prior Publication Data

US 2018/0334342 A1 Nov. 22, 2018

(30) Foreign Application Priority Data

May 17, 2017 (JP) ..... 2017-098387

(51) Int. Cl.
*B65H 5/06* (2006.01)
*B65H 7/00* (2006.01)
(Continued)

(52) U.S. Cl.
CPC ..... *B65H 7/00* (2013.01); *B65H 5/06* (2013.01); *B65H 5/062* (2013.01); *B65H 7/06* (2013.01); *G03G 15/6529* (2013.01); *G03G 15/80* (2013.01); *B65H 2403/92* (2013.01); *B65H 2403/943* (2013.01); *B65H 2403/944* (2013.01);
(Continued)

(58) Field of Classification Search
CPC ..... B65H 5/06; B65H 5/062; B65H 5/064; B65H 9/004; B65H 9/006; B65H 9/008; B65H 9/14; B65H 15/00; B65H 29/12; B65H 29/125; B65H 85/00; B65H 2403/732; B65H 2403/943; B65H 2403/944; B65H 2404/16; B65H 2404/162; B65H 2404/165; B65H 2404/166; B65H 2515/32; B65H 2515/322; B65H 2555/24; B65H 2555/25; B65H 2555/252; B65H 2555/26
See application file for complete search history.

(56) References Cited

U.S. PATENT DOCUMENTS 6,019,365 A * 2/2000 Matsumura ..... B65H 7/10 271/227
6,168,153 B1 * 1/2001 Richards ..... B65H 5/062 271/226
(Continued)

FOREIGN PATENT DOCUMENTS

JP 2001270180 A 10/2001

*Primary Examiner* — Ernesto A Suarez
(74) *Attorney, Agent, or Firm* — Buchanan Ingersoll & Rooney PC

(57) ABSTRACT

A sheet conveying apparatus includes: a plurality of conveyors provided along a sheet conveying direction; a plurality of main driving parts that is respectively provided to the plurality of conveyors and independently drives the conveyors; an auxiliary driving part that drives the plurality of conveyors; and a transmitter that transmits driving force between the plurality of conveyors and transmits driving force of the auxiliary driving part to the plurality of conveyors.

11 Claims, 8 Drawing Sheets

(51) Int. Cl.
*B65H 7/06* (2006.01)
*G03G 15/00* (2006.01)

(52) U.S. Cl.
CPC .. *B65H 2511/212* (2013.01); *B65H 2513/212* (2013.01); *B65H 2515/32* (2013.01); *B65H 2555/25* (2013.01); *B65H 2555/26* (2013.01); *B65H 2801/06* (2013.01); *G03G 15/50* (2013.01); *G03G 2215/00679* (2013.01); *G03G 2221/1657* (2013.01)

(56) References Cited

U.S. PATENT DOCUMENTS

| | | | | |
|---|---|---|---|---|
| 6,530,569 | B2 * | 3/2003 | Yamagishi | B65H 5/062 271/270 |
| 6,896,256 | B2 * | 5/2005 | Hozumi | B65H 5/062 271/228 |
| 7,971,878 | B2 * | 7/2011 | Hashimoto | G03G 15/0131 198/624 |
| 8,474,816 | B2 * | 7/2013 | Ishizaki | B65H 9/006 271/270 |
| 9,617,096 | B2 * | 4/2017 | Kii | B65H 7/00 |
| 2007/0284803 | A1 * | 12/2007 | Oomori | B65H 3/0669 271/10.01 |

* cited by examiner

FIG. 7A

ACCELERATION OF MOTOR (rad/s$^2$)

| NUMBER OF REVOLUTIONS OF MOTOR (rpm) | 100 OR LESS | 100 | 200 | 300 | 400 | 500 |
|---|---|---|---|---|---|---|
| 100 | 0 | 0 | 0 | 0 | 0 | 0 |
| 200 | 0 | 0 | 0 | 0 | 0 | 0 |
| 300 | 0 | 0 | 0 | 0 | 0 | 10 |
| 400 | 0 | 0 | 0 | 0 | 10 | 20 |
| 500 | 0 | 0 | 0 | 10 | 20 | 30 |
| 600 | 0 | 0 | 10 | 20 | 30 | 40 |
| 700 | 0 | 10 | 20 | 30 | 40 | 50 |
| 800 | 10 | 20 | 30 | 40 | 50 | 60 |
| 900 | 20 | 30 | 40 | 50 | 60 | 70 |
| 1000 | 30 | 40 | 50 | 60 | 70 | 80 |

FIG. 7B

ACCELERATION OF MOTOR (rad/s$^2$)

| NUMBER OF REVOLUTIONS OF MOTOR (rpm) | 100 OR LESS | 100 | 200 | 300 | 400 | 500 |
|---|---|---|---|---|---|---|
| 100 | 0 | 0 | 0 | 0 | 0 | 10 |
| 200 | 0 | 0 | 0 | 0 | 10 | 20 |
| 300 | 0 | 0 | 0 | 10 | 20 | 30 |
| 400 | 0 | 0 | 10 | 20 | 30 | 40 |
| 500 | 0 | 10 | 20 | 30 | 40 | 50 |
| 600 | 10 | 20 | 30 | 40 | 50 | 60 |
| 700 | 20 | 30 | 40 | 50 | 60 | 70 |
| 800 | 30 | 40 | 50 | 60 | 70 | 80 |
| 900 | 40 | 50 | 60 | 70 | 80 | 90 |
| 1000 | 50 | 60 | 70 | 80 | 90 | 100 |

FIG. 8A ACCELERATION CURVE
FIG. 8B OVER-ASSIST DUTY UPPER LIMIT
FIG. 8C TORQUE SHORTAGE
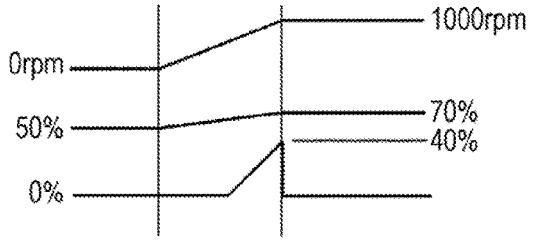
FIG. 9A
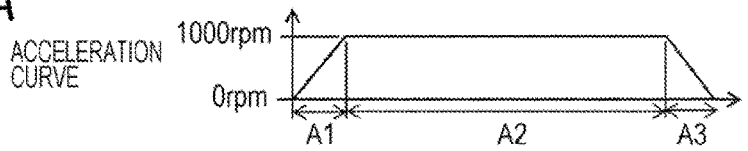
FIG. 9B
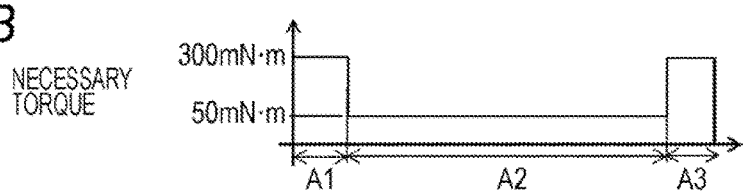
FIG. 9C
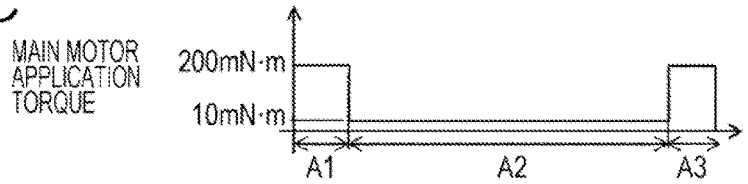
FIG. 9D
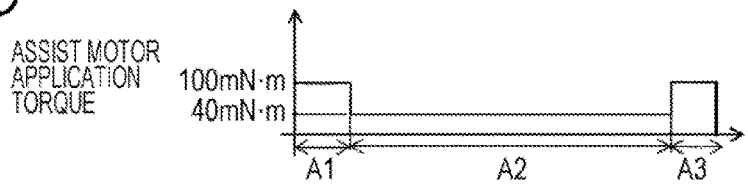

SHEET CONVEYING APPARATUS AND IMAGE FORMING APPARATUS

The entire disclosure of Japanese patent Application No. 2017-098387, filed on May 17, 2017, is incorporated herein by reference in its entirety.

BACKGROUND

Technological Field

The present invention relates to a sheet conveying apparatus that conveys a sheet and an image forming apparatus including the sheet conveying apparatus.

Description of the Related Art

In a configuration in which a driven object is driven by a motor, a technique has been devised for supplementing torque by including another auxiliary motor that drives the driven object to supplement a torque shortage of the motor (for example, see JP 2001-270180 A). A sheet conveying apparatus that conveys a sheet of an image forming apparatus or the like, includes conveying members such as a roller and a belt, and a motor that drives the conveying members.

The sheet conveying apparatus includes a plurality of conveying members along a conveying direction of the sheet, and an auxiliary motor for each of the conveying members where the torque shortage occurs, and independently performs torque assist by each of the conveying members in a case where the torque shortage occurs.

However, in a configuration in which the plurality of conveying members is respectively driven by independent auxiliary motors, there are cases where the plurality of conveying members is not synchronized with each other when the torque assist is performed. For this reason, the sheet is pulled or loosened between the conveying members, which applies a load on the sheet and causes a conveyance failure.

SUMMARY

The present invention has been made to solve such a problem, and it is an object of the present invention to provide a sheet conveying apparatus and an image forming apparatus capable of synchronizing the plurality of conveying members to perform torque assist.

To achieve the abovementioned object, according to an aspect of the present invention, a sheet conveying apparatus reflecting one aspect of the present invention comprises: a plurality of conveyors provided along a sheet conveying direction; a plurality of main driving parts that is respectively provided to the plurality of conveyors and independently drives the conveyors; an auxiliary driving part that drives the plurality of conveyors; and a transmitter that transmits driving force between the plurality of conveyors and transmits driving force of the auxiliary driving part to the plurality of conveyors.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 7A and 7B are explanatory diagrams each illustrating an example of an assist table;

FIGS. 8A to 8C are explanatory diagrams illustrating a function and effect of a torque limiter;

FIGS. 9A to 9D are explanatory diagrams illustrating an example of torque distribution between a main motor and an assist motor.

DETAILED DESCRIPTION OF EMBODIMENTS

Hereinafter, one or more embodiments of a sheet conveying apparatus and an image forming apparatus according to the present invention will be described with reference to the drawings. However, the scope of the invention is not limited to the disclosed embodiments.

<Configuration Example of Sheet Conveying Apparatus of Present Embodiment>

Figure 1:
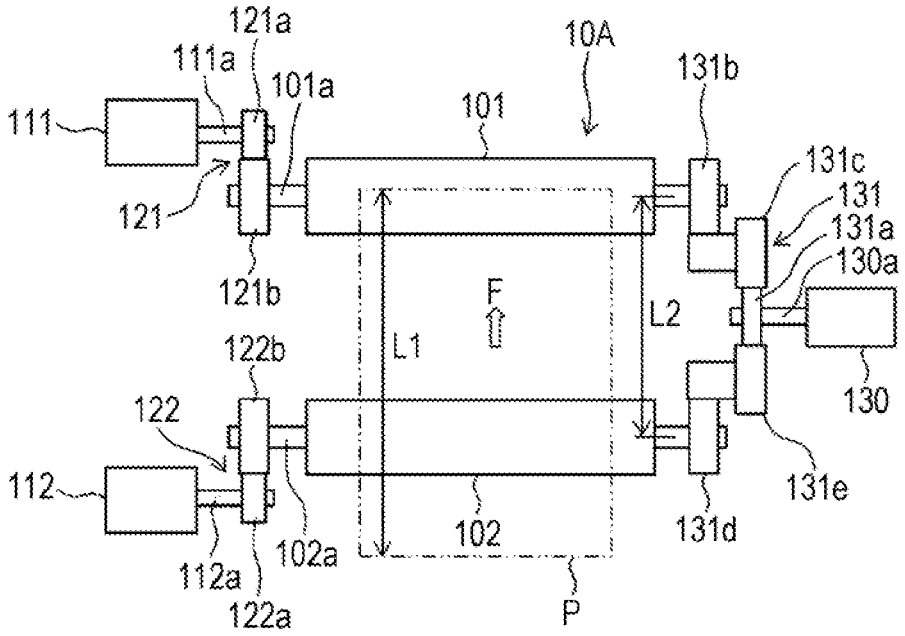
FIG. 1 is a configuration diagram illustrating an example of a sheet conveying apparatus of a first embodiment.

FIG. 1 is a configuration diagram illustrating an example of a sheet conveying apparatus of a first embodiment. A sheet conveying apparatus 10A of the first embodiment includes a plurality of conveying rollers 101 and 102 along a conveying direction of a sheet P indicated by an arrow F.

The conveying roller 101 and the conveying roller 102 are examples of conveyors and each includes a pair of rollers that sandwiches the sheet P and rotates to convey the sheet P. In the present embodiment, a configuration is illustrated including two sets of conveying rollers 101 and 102 along the conveying direction of the sheet P; however, the configuration may include two or more sets of rollers.

A distance between the conveying roller 101 and the conveying roller 102 is made shorter than a length L in the conveying direction of the sheet P, and in a state in which the sheet P is conveyed to a position where the front end of the sheet P reaches the conveying roller 101 on the downstream side in the conveying direction of the sheet P, the rear end of the sheet P is in a state of being sandwiched by the conveying roller 102 on the upstream side in the conveying direction of the sheet P.

In the sheet conveying apparatus 10A, the plurality of conveying rollers 101 and 102 is driven by independent driving parts, respectively. For this reason, the sheet conveying apparatus 10A includes a main motor 111 that drives the conveying roller 101 and a transmission member 121 that transmits driving force of the main motor 111 to the conveying roller 101. In addition, the sheet conveying apparatus 10A includes a main motor 112 that drives the conveying roller 102 and a transmission member 122 that transmits driving force of the main motor 112 to the conveying roller 102.

The main motor 111 is an example of a main driving part and includes a stepping motor or a brushless motor. The transmission member 121 is an example of a transmitter, and in this example, includes a gear 121*a* provided to a shaft 111*a* of the main motor 111 and a gear 121*b* provided to a shaft 101*a* of the conveying roller 101. In the transmission member 121, the gear 121*a* and the gear 121*b* mesh, whereby the driving force of the main motor 111 is transmitted to the conveying roller 101.

The main motor 112 is an example of the main driving part and includes a stepping motor or a brushless motor. The transmission member 122 is an example of the transmitter, and in this example, includes a gear 122*a* provided to a shaft 112*a* of the main motor 112 and a gear 122*b* provided to the shaft 102*a* of the conveying roller 102. In the transmission member 122, the gear 122*a* and the gear 122*b* mesh, whereby the driving force of the main motor 112 is transmitted to the conveying roller 102.

In the sheet conveying apparatus 10A, the conveying roller 101 driven by the main motor 111 and the conveying roller 102 driven by the main motor 112 are synchronously driven by a single auxiliary driving part. For this reason, the sheet conveying apparatus 10A includes an assist motor 130 that drives the conveying roller 101 and the conveying roller 102, and a transmission member 131 that transmits driving force of the assist motor 130 to the conveying roller 101 and the conveying roller 102.

The assist motor 130 is an example of the auxiliary driving part and includes a brushless motor or a brushed motor. The transmission member 131 is an example of the transmitter, and includes a gear, a pulley, a belt, and the like that connect shafts of the conveying roller 101 and the conveying roller 102 together.

In the present embodiment, the transmission member 131 includes a gear 131*a* provided to a shaft 130*a* of the assist motor 130, a gear 131*b* provided to the shaft 101*a* of the conveying roller 101, and a gear 131*c* that meshes with the gear 131*a* and the gear 131*b*. In addition, the transmission member 131 includes a gear 131*d* provided to the shaft 102*a* of the conveying roller 102 and a gear 131*e* that meshes with the gear 131*a* and the gear 131*d*.

As a result, the driving force of the assist motor 130 is transmitted to the conveying roller 101 via the gear 131*a*, the gear 131*c*, and the gear 131*b*. In addition, the driving force of the assist motor 130 is transmitted to the conveying roller 102 via the gear 131*a*, the gear 131*e*, and the gear 131*d*. Further, the conveying roller 101 and the conveying roller 102 are connected together via the above-described gears, and can be synchronously rotated.

Figure 2:
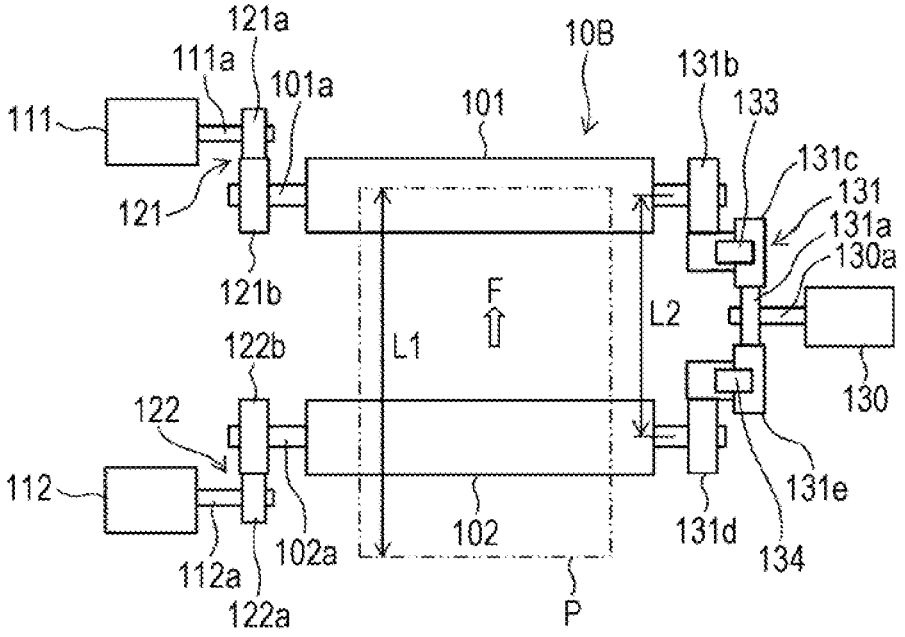
FIG. 2 is a configuration diagram illustrating an example of a sheet conveying apparatus of a second embodiment.

FIG. 2 is a configuration diagram illustrating an example of a sheet conveying apparatus of a second embodiment. In a sheet conveying apparatus 10B of the second embodiment, the same components as those of the above-described sheet conveying apparatus 10A of the first embodiment are denoted by the same reference numerals, and a detailed description thereof will be omitted.

The sheet conveying apparatus 10B of the second embodiment includes a torque limiter 133 in the transmission member 131 that transmits the driving force from the assist motor 130 to the conveying roller 101, and a torque limiter 134 in the transmission member 131 that transmits the driving force from the assist motor 130 to the conveying roller 102.

The torque limiters 133 and 134 each are an example of a driving force shut-off part, and shuts off output when driving force exceeding a predetermined value is input from the assist motor 130 or the conveying rollers 101 and 102.

In this example, the torque limiter 133 is provided to the gear 131*c* that transmits the driving force from the assist motor 130 to the conveying roller 101, and the torque limiter 134 is provided to the gear 131*e* that transmits the driving force from the assist motor 130 to the conveying roller 102.

The torque limiter 133 transmits the driving force from the assist motor 130 to the conveying roller 101 when the driving force input from the assist motor 130 is the predetermined value or less. In addition, the torque limiter 134 transmits the driving force from the assist motor 130 to the conveying roller 102 when the driving force input from the assist motor 130 is the predetermined value or less.

On the other hand, the torque limiter 133 shuts off transmission of the driving force from the assist motor 130 to the conveying roller 101 when the driving force input from the assist motor 130 exceeds the predetermined value. In addition, the torque limiter 134 shuts off transmission of the driving force from the assist motor 130 to the conveying roller 102 when the driving force input from the assist motor 130 exceeds the predetermined value.

Further, when driving force due to external force tending to rotate the conveying roller 101 exceeds the predetermined value, the torque limiter 133 shuts off transmission of the driving force from the conveying roller 101 to the assist motor 130 and the conveying roller 102. In addition, when driving force due to external force tending to rotate the conveying roller 102 exceeds the predetermined value, the torque limiter 134 shuts off transmission of the driving force from the conveying roller 102 to the assist motor 130 and the conveying roller 101.

Figure 3:
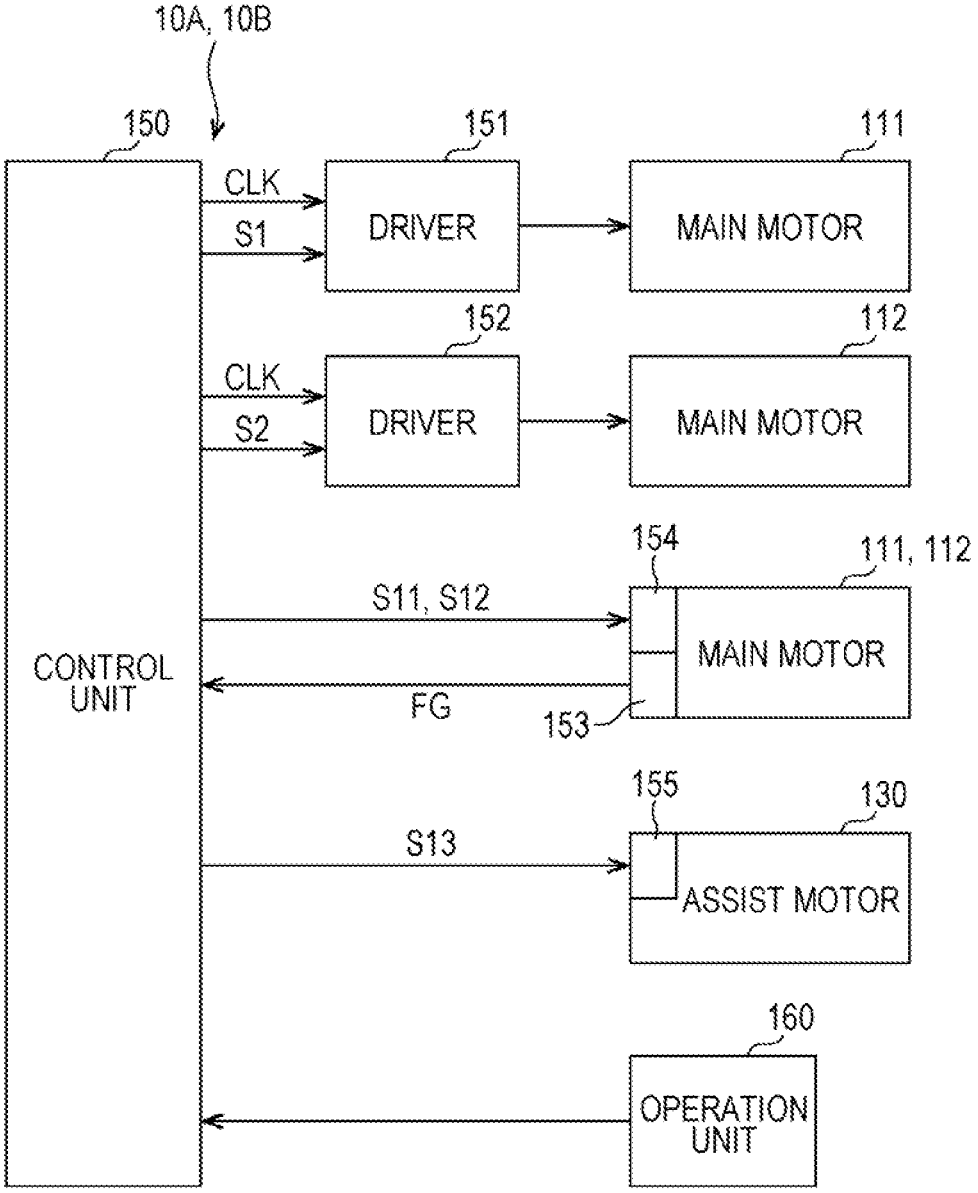
FIG. 3 is a functional block diagram illustrating an example of a control system of a sheet conveying apparatus of the present embodiment.

FIG. 3 is a functional block diagram illustrating an example of a control system of a sheet conveying apparatus of the present embodiment. The sheet conveying apparatuses 10A and 10B include the main motor 111, the main motor 112, a control unit 150 that controls the assist motor 130, and an operation unit 160 in which operation of setting sheet information such as a sheet type, size, basis weight, and the like of the sheet P is performed.

The control unit 150 outputs a control signal based on control information for controlling the number of revolutions, acceleration, and the like of the main motor 111, and controls the main motor 111 to rotate the conveying roller 101. In addition, the control unit 150 outputs a control signal based on control information for controlling the number of revolutions, acceleration, and the like of the main motor 112, and controls the main motor 112 to rotate the conveying roller 102. Rotational speeds of the main motor 111 and the main motor 112 are synchronized with each other, whereby the sheet P is conveyed by the conveying roller 101 and the conveying roller 102.

On the basis of the control information of the main motors 111 and 112 and the sheet information of the sheet P to be conveyed, the control unit 150 determines whether or not to perform torque assist to the conveying rollers 101 and 102, and in a case where the torque assist is performed, determines the torque. When it is determined to perform the torque assist, the control signal for controlling torque of the assist motor 130 is output in accordance with the number of revolutions, acceleration, and the like of the main motors 111 and 112, the assist motor 130 is controlled, and torque assist is performed to the conveying rollers 101 and 102.

In a case where the main motor 111 is a stepping motor, a driver 151 is included that outputs a current for driving the main motor 111 on the basis of a control signal S1 and a synchronization signal CLK output from the control unit 150. The control unit 150 outputs the control signal S1 for causing the main motor 111 to have desired number of revolutions and acceleration, and controls the number of revolutions and acceleration of the main motor 111.

In a case where the main motor 112 is a stepping motor, similarly, a driver 152 is included that outputs a current for driving the main motor 112 on the basis of a control signal S2 and the synchronization signal CLK output from the control unit 150. The control unit 150 outputs the control signal S2 for causing the main motor 112 to have desired number of revolutions and acceleration, and controls the number of revolutions and acceleration of the main motor 112.

In a case where the main motors 111 and 112 are brushless motors, the main motors 111 and 112 include a position detector 153 for detecting the position of a rotor (not illustrated), and a driver 154 that outputs currents for driving the main motors 111 and 112 on the basis of the control signals S11 and S12 output from the control unit 150. On the basis of a Frequency Generator (FG) signal input from the position detector 153, the control unit 150 detects the position, rotation direction, and the like of the rotor (not illustrated), and outputs control signals for causing the main motors 111 and 112 to have desired number of revolutions and acceleration, and controls the number of revolutions and acceleration of the main motors 111 and 112.

In a case where the assist motor 130 is a brushless motor, the assist motor 130 includes a driver 155 that outputs a current for driving the assist motor 130 on the basis of a control signal S13 output from the control unit 150. The control unit 150 outputs the control signal S13 for causing the assist motor 130 to have desired torque, and controls the torque of the assist motor 130.

<Configuration Example of Image Forming Apparatus of Present Embodiment>

Figure 4:
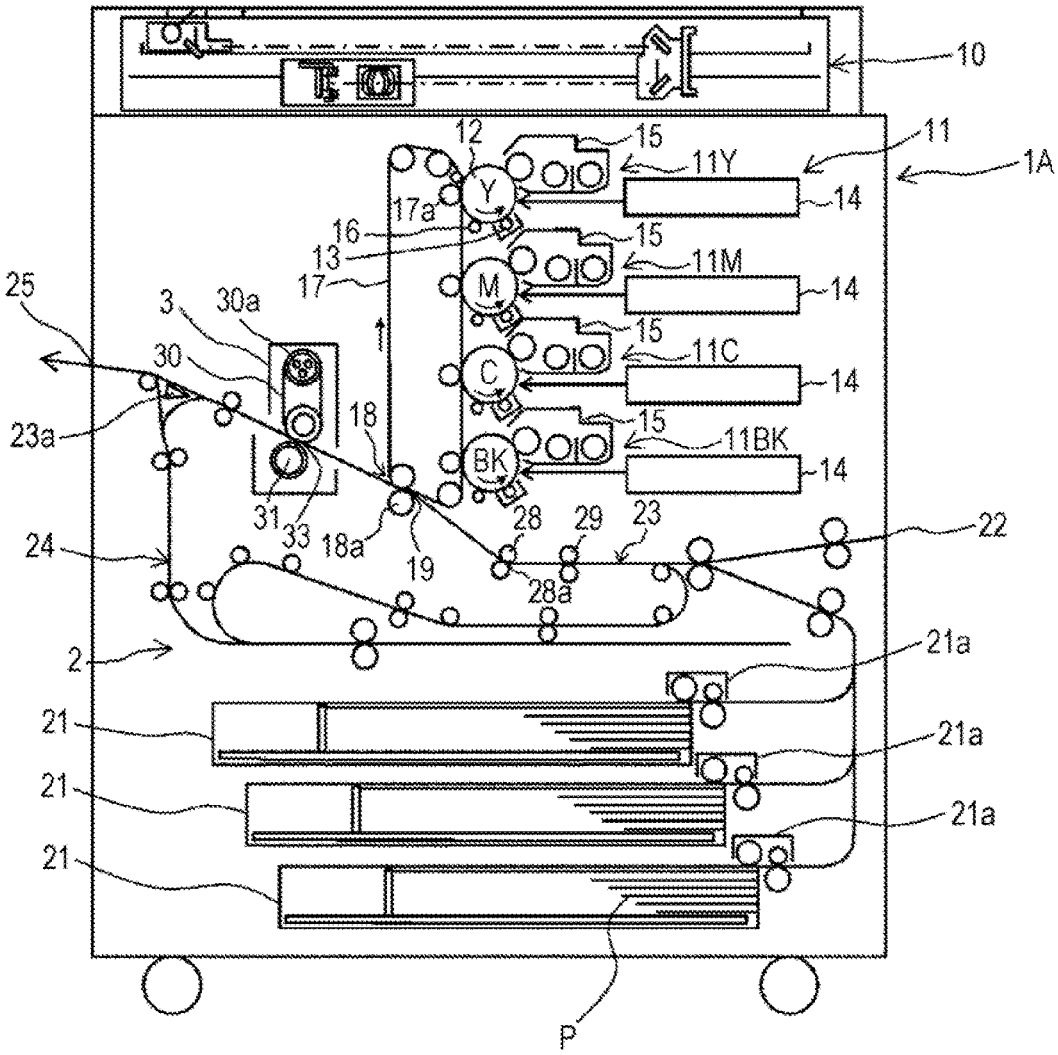
FIG. 4 is a configuration diagram illustrating an example of an image forming apparatus of the present embodiment.

FIG. 4 is a configuration diagram illustrating an example of the image forming apparatus of the present embodiment. An image forming apparatus 1A of the present embodiment is an electrophotographic image forming apparatus such as a copying machine, and in this example, the image forming apparatus 1A is a color image forming apparatus that arranges a plurality of photoconductors to face one intermediate transfer belt to form a full-color image.

The image forming apparatus 1A includes an image forming unit 11Y that forms a yellow (Y) image, an image forming unit 11M that forms a magenta (M) image, an image forming unit 11C that forms a cyan (C) image, and an image forming unit 11BK that forms a black (BK) image.

Each of the image forming units 11Y, 11M, 11C, and 11BK is an example of an image forming part, and includes a photosensitive drum 12, a charging unit 13 that charges the photosensitive drum 12, an optical writing unit 14 that forms a latent image on the photosensitive drum 12, a developing unit 15 that develops the latent image, and a cleaning unit 16 that cleans and neutralizes the photosensitive drum 12.

The photosensitive drum 12 is an example of an image carrier, and the surface cleaned and neutralized by the cleaning unit 16 is charged by the charging unit 13, and the latent image is formed by scanning exposure by the optical writing unit 14. The developing unit 15 is an example of a developing part and supplies toner to the photosensitive drum 12.

In each of the image forming units 11Y, 11M, 11C, and 11BK, the toner is supplied from the developing unit 15 to the photosensitive drum 12, whereby the latent image is developed and visualized. In the image forming unit 11Y, a toner image corresponding to yellow is formed on the photosensitive drum 12. In the image forming unit 11M, a toner image corresponding to magenta is formed as a predetermined color image on the photosensitive drum 12. In the image forming unit 11C, a toner image corresponding to cyan is formed on the photosensitive drum 12. In the image forming unit 11BK, a toner image corresponding to black is formed on the photosensitive drum 12.

The image forming apparatus 1A includes an intermediate transfer belt 17 to which the toner image formed on the photosensitive drum 12 is primarily transferred, and a primary transfer roller 17*a* that transfers the toner image to the intermediate transfer belt 17. The intermediate transfer belt 17 that is an example of the image carrier and is a belt-like intermediate transfer member is driven in the arrow direction, whereby the toner image formed on each photosensitive drum 12 is sequentially transferred to a predetermined position on the transfer belt 17 by each primary transfer roller 17*a*.

The image forming apparatus 1A includes a secondary transfer unit 18 that secondarily transfers the toner image made of each color transferred onto the intermediate transfer belt 17, onto the sheet P or the like. The secondary transfer unit 18 is an example of a transfer part, and the intermediate transfer belt 17 is provided on the side facing one surface of the sheet P, and a secondary transfer roller 18*a* is provided on the side facing the other surface of the sheet P.

The secondary transfer unit 18 is provided to be movable in a direction in which the secondary transfer roller 18*a* that is a transfer member comes into contact with and away from the intermediate transfer belt 17, and the secondary transfer roller 18*a* is pressed against the intermediate transfer belt 17, whereby a transfer nip portion 19 is formed. In the secondary transfer unit 18, the sheet P is pressed against the intermediate transfer belt 17 at the transfer nip portion 19, and the secondary transfer roller 18*a* is rotationally driven at the same speed as the intermediate transfer belt 17, whereby the toner image is transferred onto the sheet P.

In the secondary transfer unit 18, to transfer the toner image onto the sheet, a positive voltage is applied from the back surface side of the sheet by the secondary transfer roller 18*a*. As a result, in the sheet passing through the secondary transfer unit 18, an image forming surface side where the toner image is transferred is negatively charged, and the back surface side is positively charged.

The image forming apparatus 1A includes a sheet conveying unit 2 that conveys the sheet P or the like. In addition, the image forming apparatus 1A includes, in this example, a plurality of sheet feeding trays 21 in which the sheet P is stored, and sheet feeding units 21*a* that feed the sheet P stored in the respective sheet feeding trays 21.

The sheet conveying unit 2 is applied with the above-described sheet conveying apparatuses 10A and 10B of the present embodiment, and includes a main conveying path 23 constituting a conveying path of the sheet P passing through the secondary transfer unit 18 and a reverse conveying path 24 constituting a conveying path in which the front and back surface sides of the sheet P are reversed. The main conveying path 23 joins a conveying path of the sheet P fed from each of the sheet feeding units 21*a* and a conveying path of the sheet or the like fed from an external sheet feeding port 22, and is connected to an ejection port 25.

The reverse conveying path 24 constitutes a conveying path for reversing the conveying direction of the sheet P to determine the front and back surface sides. The sheet conveying unit 2 includes a switching gate 23*a* at a branching point between the main conveying path 23 and the reverse conveying path 24 and switches the sheet path of the sheet P by operation of forming images on both front and back surfaces of the sheet P.

The sheet conveying unit 2 includes a registration roller 28 that corrects an inclination of the sheet P referred to as skew with respect to the sheet P conveyed in the forward direction on the main conveying path 23, and a positional deviation with respect to the main scanning direction of the image that is the width direction of the sheet P perpendicular to the conveying direction. In addition, the sheet conveying unit 2 includes a loop roller 29 that causes the sheet P to abut on the registration roller 28.

The registration roller 28 is an example of an oscillation member constituting a correction part, and includes a pair of rollers that face each other sandwiching the sheet P conveyed on the main conveying path 23. The registration roller 28 includes a shaft extending along the main scanning direction of the image formed on the sheet P, and conveys the sheet P in a direction perpendicular to the shaft.

The registration roller 28 is configured to be movable in a direction in which the pair of rollers comes into contact with and away from each other, by a driving mechanism (not illustrated), and forms a nip portion 28*a* by press-contacting the pair of rollers. In a state in which the rotation of the registration roller 28 is stopped, the sheet P is caused to abut on the nip portion 28*a*, whereby the inclination of the sheet P is corrected. In addition, when the sheet P enters between the pair of pressure-contacted rollers, the registration roller 28 sandwiches the sheet P, and rotates to convey the sheet P.

The registration roller 28 sandwiches the sheet P and moves in the shaft direction, to correct the position of the sheet P in the main scanning direction. Further, after correcting the position of the sheet P in the main scanning direction, the pair of rollers are moved away from each other in the shaft direction, whereby the registration roller 28 returns to the initial position independently of the conveyance of the sheet P.

The loop roller 29 constitutes the correction part and includes a pair of rollers facing each other sandwiching the sheet P conveyed on the main conveying path 23, and is provided on the upstream side of the registration roller 28 in the conveying direction of the sheet P. The loop roller 29 includes a shaft extending along the main scanning direction of the image formed on the sheet P, and conveys the sheet P in a direction perpendicular to the shaft.

In a state in which the registration roller 28 is stopped, the sheet P is conveyed by the loop roller 29, the front end of the sheet P is caused to abut on the nip portion 28*a* including a contact portion of the pair of rollers, and the sheet P is conveyed until the sheet P is in a state referred to as a loop, whereby the inclination is corrected in the direction along the surface of the sheet P.

After the inclination of the sheet P is corrected, the registration roller 28 is rotationally driven along the conveying direction of the sheet P, whereby the sheet P is sandwiched and conveyed. Further, the registration roller 28 is caused to move in the shaft direction, whereby the position of the sheet P is corrected in the main scanning direction. As described above, a series of sheet position correction operations for correcting the inclination of the sheet P and the deviation of the position in the main scanning direction is referred to as registration oscillation.

The image forming apparatus 1A includes a fixing unit 3 that fixes the toner image transferred onto the sheet P by the secondary transfer unit 18. The fixing unit 3 is an example of a fixing part, and includes a fixing belt 30 that heats the sheet P and a pressure roller 31 that presses the sheet P against the fixing belt 30.

In the fixing unit 3, the pressure roller 31 is pressed against the fixing belt 30, whereby a fixing nip portion 33 is formed. In a state in which the pressure roller 31 is pressed against the fixing belt 30, the pressure roller 31 is rotationally driven and the heater 30*a* is electrified, whereby the sheet P sandwiched by the fixing nip portion 33 is conveyed, and the image is fixed on the sheet P by pressure and heat.

The image forming apparatus 1A includes a document reading unit 10. The document reading unit 10 performs scanning exposure of a document image by an optical system of a scanning exposure apparatus, and reads reflected light by a line image sensor, thereby obtaining an image signal. The image forming apparatus 1A may have a configuration in which an automatic document conveying apparatus (not illustrated) for feeding a document is provided at the top.

In the image forming apparatus 1A, for example, the registration roller 28 includes the conveying roller 101 of the sheet conveying apparatus 10A and 10B, and the loop roller 29 includes the conveying roller 102.

<Operation Example of Sheet Conveying Apparatus and Image Forming Apparatus of Present Embodiment>

Figure 5:
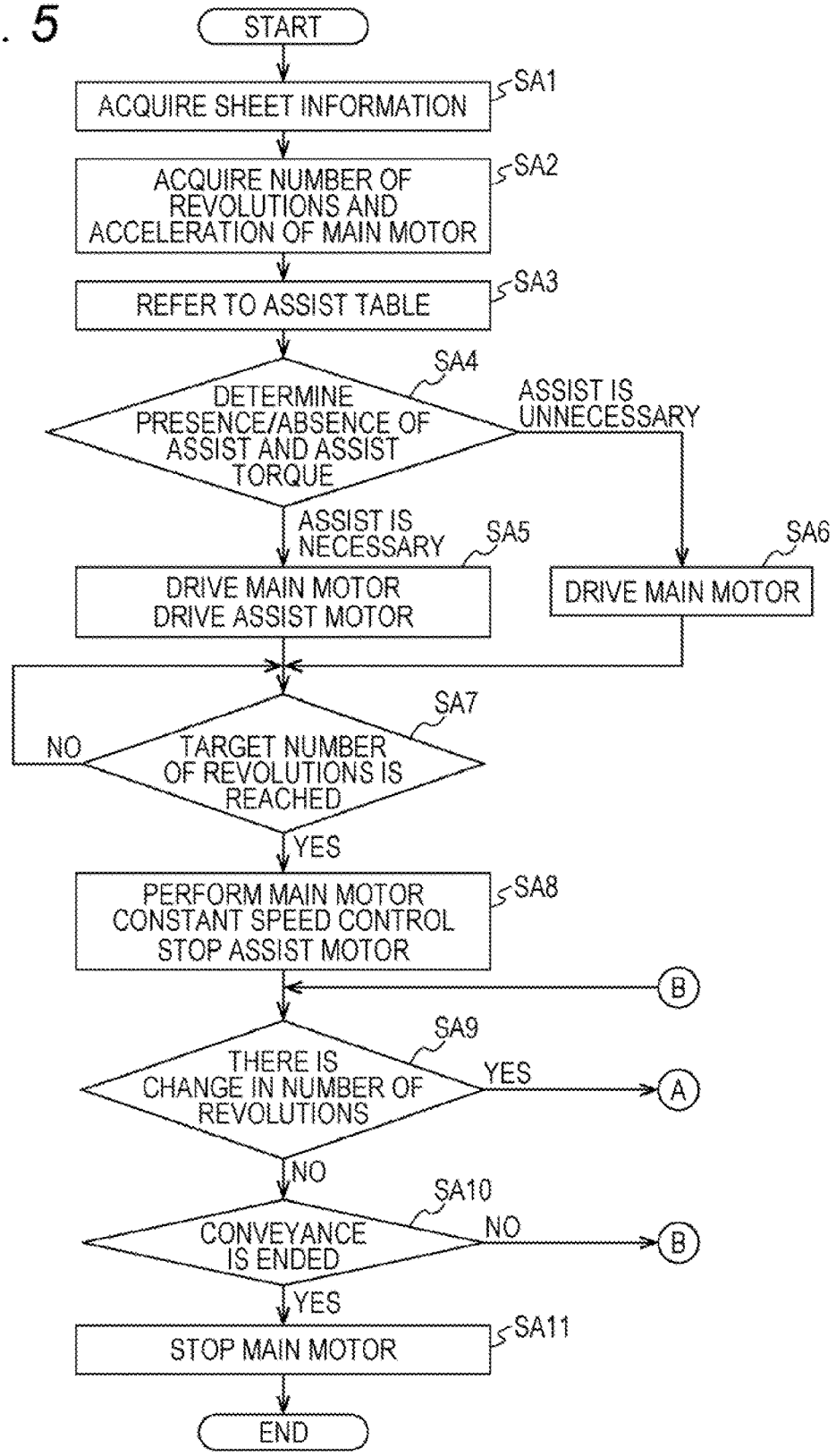
FIG. 5 is a flowchart illustrating an example of operation of the sheet conveying apparatus of the present embodiment.
Figure 6:
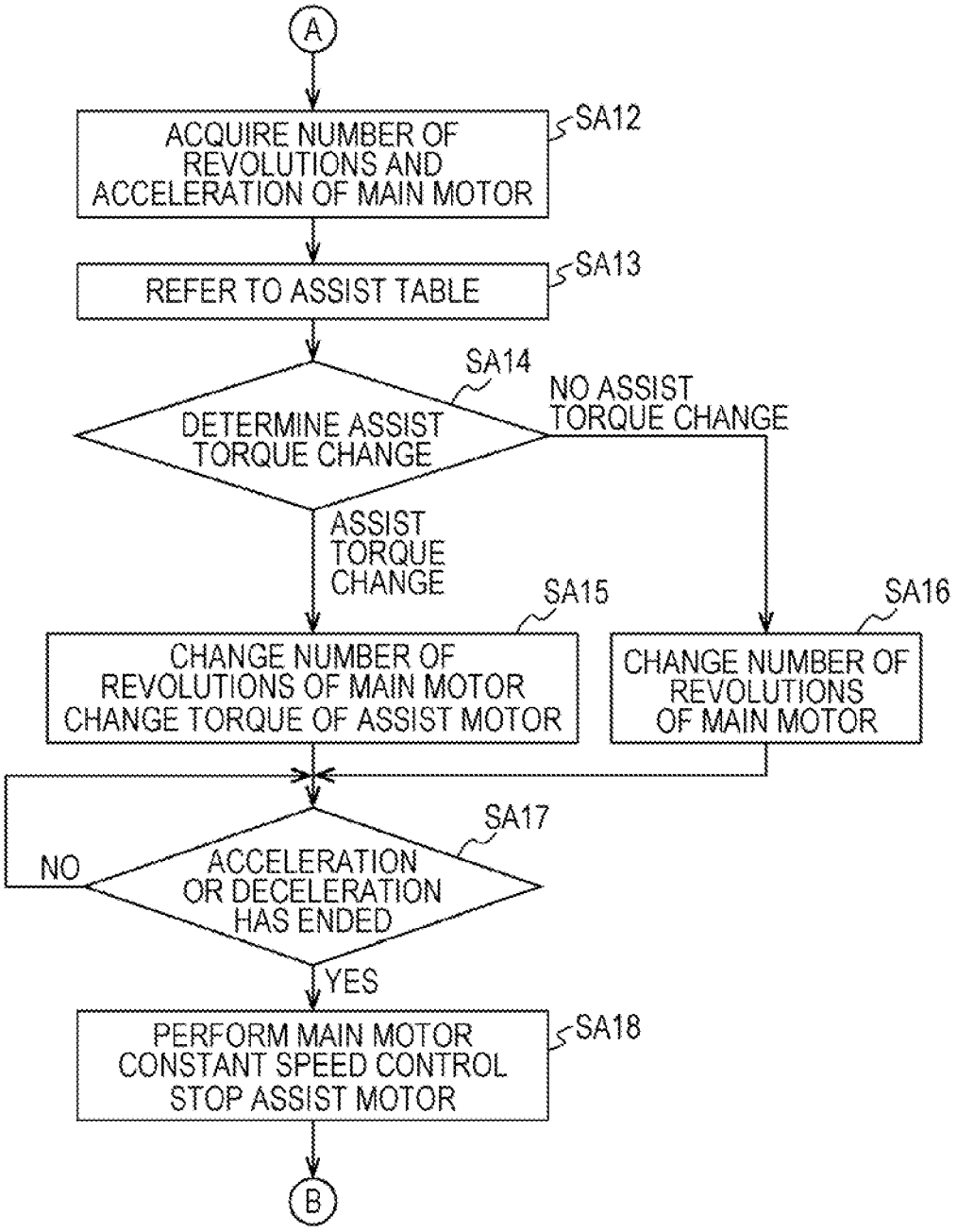
FIG. 6 is a flowchart illustrating an example of the operation of the sheet conveying apparatus of the present embodiment.

FIGS. 5 and 6 are flowcharts illustrating an example of operation of the sheet conveying apparatus of the present embodiment, and with reference to the drawings, description will be made for the sheet conveying apparatus 10A of the first embodiment and the sheet conveying apparatus 10B of the second embodiment, and operation of the image forming apparatus to which the sheet conveying apparatuses 10A and 10B are applied.

In a configuration in which both of the main motors 111 and 112 are stepping motors, in the sheet conveying apparatuses 10A and 10B, the number of revolutions and torque of each of the main motors 111 and 112 are, for example, 600 rpm and 200 mN·m, respectively.

In a configuration in which one of the main motors 111 and 112, for example, the main motor 111 is a stepping motor, and the main motor 112 is a brushless motor, the number of revolutions and torque of the main motor 111 are, for example, 600 rpm and 200 mN·m, respectively, and the number of revolutions and torque of the main motor 112 are, for example, 600 rpm and 300 mN·m, respectively.

In a configuration in which the assist motor 130 is a brushless motor, the number of revolutions and torque of the assist motor 130 are, for example, 600 rpm and 200 mN·m, respectively, and the conveying roller 101 and the conveying roller 102 are driven by the single assist motor 130, so that the maximum value of the torque that can be assisted is 100 mN·m per roller.

In step SA1 of FIG. 5, the control unit 150 acquires sheet information of the sheet P set by the operation unit 160 and the like, in operation of conveying the sheet P in image forming operation in the image forming apparatus 1A. In addition, in step SA2 of FIG. 5, the control unit 150 acquires the number of revolutions of the main motors 111 and 112 and the acceleration until the number of revolutions is reached.

The control unit 150 refers to an assist table in which a value of torque assisted by the assist motor 130 is set, in step SA3 of FIG. 5, and determines whether or not to perform torque assist on the conveying rollers 101 and 102, and determines the torque in a case where the torque assist is performed, in step SA4 of FIG. 5.

FIGS. 7A and 7B are explanatory diagrams each illustrating an example of the assist table. In an assist table 200, the number of revolutions (rpm) of the main motors 111 and 112, the acceleration (rad/$S^2$) until the number of revolutions is reached, and the torque (mN·m) to be assisted are set. Here, the assist motor 130 is subjected to pulse width modulation control (PWM), and the torque is 100 (mN·m) in a case where the duty ratio is 100(%).

Since the torque to be assisted varies depending on the load, the assist table 200 is set in accordance with the sheet type, size, and the like of the sheet. In FIGS. 7A and 7B, assist tables 200 are respectively disclosed having different settings depending on the magnitude of the load. FIG. 7A illustrates a case where the load is small, and FIG. 7B illustrates a case where the load is large. Incidentally, the values of the number of revolutions, acceleration, and torque are merely examples, and the present invention is not limited thereto.

In a case where the torque assist by the assist motor 130 is necessary on the basis of the setting of the assist table 200, in step SA5 of FIG. 5, the control unit 150 outputs control signals for causing the main motors 111 and 112 to reach desired number of revolutions at desired acceleration. In addition, a control signal is output for causing the assist motor 130 to generate desired torque. In a case where the torque assist by the assist motor 130 is unnecessary, in step SA6 of FIG. 5, a control signal is output for causing the main motors 111 and 112 to reach the desired number of revolutions at the desired acceleration. As a result, the conveying roller 101 and the conveying roller 102 are rotated to convey the sheet P.

In step SA7 of FIG. 5, the control unit 150 determines whether or not the main motors 111 and 112 have reached the desired target number of revolutions. When it is determined that the main motors 111 and 112 have reached the target number of revolutions, the control unit 150 outputs a control signal for causing the main motors 111 and 112 to rotate at constant speed, in step SA8 of FIG. 5. In addition, in a case where the torque assist by the assist motor 130 is being performed, driving of the assist motor 130 is stopped.

In step SA9 of FIG. 5, the control unit 150 determines whether or not to change the number of revolutions of the main motors 111 and 112. When it is determined not to change the number of revolutions of the main motors 111 and 112, the control unit 150 determines whether or not to end the conveyance of the sheet P, in step SA10 of FIG. 5, and when it is determined to end the conveyance of the sheet P, the control unit 150 stops the driving of the main motors 111 and 112, in step SA11 of FIG. 5.

When it is determined to change the number of revolutions of the main motors 111 and 112, in step SA9 of FIG. 5, the control unit 150 acquires the number of revolutions to be changed of the main motors 111 and 112 and the acceleration until the number of revolutions is reached, in step SA12 of FIG. 6.

The control unit 150 refers to the above-described assist table 200, in step SA13 of FIG. 6, and determines whether or not to change the torque for assisting the conveying rollers 101 and 102, and determines the torque in a case where the torque assist is performed, in step SA14 of FIG. 6.

In the case of changing the assisting torque on the basis of the setting of the assist table 200, the control unit 150 outputs control signals for causing the main motors 111 and 112 to reach the desired number of revolutions changed at the desired acceleration, in step SA15 of FIG. 6. In addition, a control signal is output for causing the assist motor 130 to generate the desired torque. In a case where the change of the assisting torque is unnecessary, in step SA16 of FIG. 6, the control signals are output for causing the main motors 111 and 112 to reach the desired number of revolutions changed at the desired acceleration.

In step SA17 of FIG. 6, the control unit 150 determines whether or not acceleration/deceleration accompanying the change in the number of revolutions of the main motors 111 and 112 has ended. When it is determined that the acceleration/deceleration of the main motors 111 and 112 has ended, the control unit 150 returns to step SA8 of FIG. 5 and outputs control signals for causing the main motors 111 and 112 to rotate at constant speed. In addition, in a case where the torque assist by the assist motor 130 is being performed, driving of the assist motor 130 is stopped.

<Function and Effect Example of Sheet Conveying Apparatus of Present Embodiment>

(a) Function and Effect Example of Torque Assist by Single Assist Motor

In the sheet conveying apparatuses 10A and 10B of the present embodiment, the shafts of the conveying roller 101 and the conveying roller 102 are connected together by a transmission member 131 including a gear and the like. As a result, even in a configuration in which the conveying roller 101 and the conveying roller 102 are respectively driven by the main motors 111 and 112 that are independent driving parts, the number of revolutions and the acceleration of the conveying roller 101 and the conveying roller 102 are synchronized with each other.

Also in the case of performing torque assist with the assist motor 130, since the driving force of the single assist motor 130 is transmitted to the conveying roller 101 and the conveying roller 102 via the transmission member 131, even in a configuration in which the types of the main motor 111 and the main motor 112 are different from each other, the number of revolutions and the acceleration of the conveying roller 101 and the conveying roller 102 are synchronized with each other.

As a result, in a case where the conveying roller 101 and the conveying roller 102 are raised to the desired number of revolutions at the desired acceleration, or the like, a shortage of the torque can be supplemented by the torque assist by the assist motor 130, and the number of revolutions and the acceleration of the conveying roller 101 and the conveying roller 102 can be synchronized with each other. Therefore, it is suppressed to be in a state in which the sheet P is pulled or loosened between the conveying roller 101 and the conveying roller 102, the load applied to the sheet P is reduced, and occurrence of a conveyance failure can be suppressed.

(b) Function and Effect Example of Torque Limiter

In a case where the main motors 111 and 112 are stepping motors, there is an upper limit to the torque that can be assisted by the assist motor 130 without causing step-out of the main motors 111 and 112 with respect to the number of revolutions of the main motors 111 and 112 set in the assist table illustrated in FIGS. 7A and 7B.

Therefore, in the sheet conveying apparatus 10B of the second embodiment described above, the transmission member 131 includes the torque limiters 133 and 134. FIGS. 8A to 8C are explanatory diagrams illustrating a function and effect of the torque limiter. The acceleration curve illustrated in FIG. 8A indicates a change in the number of revolutions when the main motors 111 and 112 are rotated from a predetermined number of revolutions, in this example, a stopped state, to 1000 (rpm) at a predetermined acceleration.

The over-assist duty upper limit illustrated in FIG. 8B indicates a change in the duty ratio that causes over-assist in which step-out occurs of the main motors 111 and 112 due to the torque assist by the assist motor 130 when the main motors 111 and 112 are rotated to 1000 (rpm).

The torque shortage illustrated in FIG. 8C indicates a change in the duty ratio when the torque shortage when the main motors 111 and 112 are rotated to 1000 (rpm) is converted into the duty ratio of the assist motor 130.

In the example illustrated in FIGS. 8A to 8C, when the duty ratio of the assist motor 130 exceeds 70%, step-out occurs of the main motors 111 and 112. On the other hand, to perform torque assist for the main motors 111 and 112, it is necessary to set the duty ratio of the assist motor 130 to 40%. Therefore, the torque upper limit value for shutting off by the torque limiters 133 and 134 is set to 40% or more and 70% or less in terms of the duty ratio, whereby step-out can be prevented of the main motors 111 and 112 due to torque assist by the assist motor 130, and assisting torque shortage can be prevented.

(c) Function and Effect Example by Switching of Torque Distribution Between Main Motor and Assist Motor In a configuration in which a stepping motor is used for each of the main motors 111 and 112, the amount of rotation of each of the conveying rollers 101 and 102 can be easily and accurately controlled. Therefore, as for the torque distribution between the main motors 111 and 112, and the assist motor 130, the main motors 111 and 112 are mainly used for position control during acceleration/deceleration of the conveying rollers 101 and 102, and the assist motor 130 is mainly used for power efficiency at constant speed.

FIGS. 9A to 9D are explanatory diagrams illustrating an example of torque distribution between the main motor and the assist motor. The acceleration curve illustrated in FIG. 9A indicates a change in the number of revolutions when the main motors 111 and 112 are rotated from a predetermined number of revolutions, in this example, a stopped state, to 1000 (rpm) at a predetermined acceleration, and rotated at constant speed for a predetermined time, and then stopped at a predetermined deceleration.

The necessary torque illustrated in FIG. 9B indicates torque necessary when the main motors 111 and 112 are rotated to 1000 (rpm) and stopped. The main motor application torque illustrated in FIG. 9C indicates torque necessary in the main motors 111 and 112 during acceleration/deceleration for increasing or decreasing the number of revolutions of the main motors 111 and 112, and at constant speed at which the number of revolutions of each of the main motors 111 and 112 is made constant, and the assist motor torque illustrated in FIG. 9D indicates torque necessary in the assist motor 130 during acceleration/deceleration and at constant speed.

For example, in a case where the torque necessary during acceleration/deceleration is 300 mN·m and the torque necessary at constant speed is 50 mN·m, the torque of the main motors 111 and 112 is controlled to be 200 mN·m, and the torque of the assist motor 130 is controlled to be 200 mN·m, in an acceleration section A1 and a deceleration section A3. In a constant speed section A2, the torque of the main motors 111 and 112 is controlled to be 10 mN·m, and the torque of the assist motor 130 is controlled to be 40 mN·m.

Since the power efficiency of the stepping motor is about 40% and the power efficiency of the brushless motor is about 80%, the torque of the assist motor 130 is increased at the constant speed and the torque of the main motors 111 and 112 is decreased, whereby power consumption can be suppressed. In addition, even if load fluctuation occurs at the constant speed at which the torque of the assist motor 130 is increased, the conveying roller 101 and the conveying roller 102 are synchronously rotated by the transmission member 131, so that the conveying roller 101 and the conveying roller 102 synchronously change the speed and synchronization can be maintained.

(d) Function and Effect Example by Torque Assist During Deceleration

FIGS. 10A to 10D are explanatory diagrams illustrating an example of torque assist during deceleration. The acceleration curve illustrated in FIG. 10A indicates a change in the number of revolutions when each of the main motors 111 and 112 is stopped at a predetermined deceleration (negative acceleration) from a state of being rotated at a predetermined number of revolutions, in this example, 1000 (rpm).

Figure 10A:
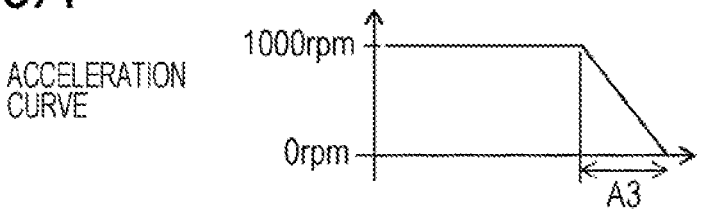
FIGS. 10A to 10D are explanatory diagrams illustrating an example of torque assist during deceleration.
Figure 10B:
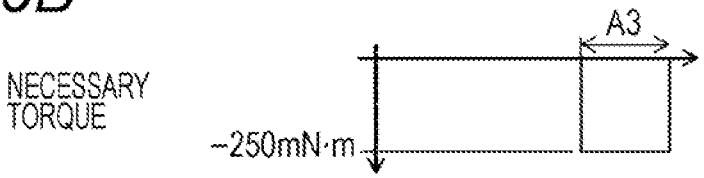

The necessary torque illustrated in FIG. 10B indicates torque necessary when each of the conveying rollers 101 and 102 to which a predetermined load is applied is stopped. The main motor application torque illustrated in FIG. 10C indicates the torque necessary in the main motors 111 and 112 during deceleration, and the assist motor torque illustrated in FIG. 10D indicates torque necessary in the assist motor 130 during deceleration.

Due to the masses of the conveying rollers 101 and 102, and the transmission members connected to the conveying rollers 101 and 102, even if driving of the main motors 111 and 112, and the assist motor 130 is stopped, the conveying rollers 101 and 102 tend to rotate due to inertia.

In operation of controlling the main motors 111 and 112 to perform braking to stop rotation of the conveying rollers 101 and 102 at the desired deceleration, in a case where the load applied to the conveying rollers 101 and 102 is light, torque generated by rotation of the conveying rollers 101 and 102 due to inertia may exceed torque that can be synchronized in the main motors 111 and 112.

For example, as illustrated in FIG. 10B, if torque necessary for stopping the conveying rollers 101 and 102 rotating due to inertia is 250 mN·m whereas the maximum synchronizing torque of the main motors 111 and 112 is 200 mN·m, step-out occurs of the main motors 111 and 112.

Figure 10C:
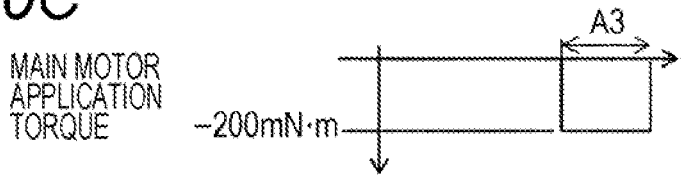
Figure 10D:
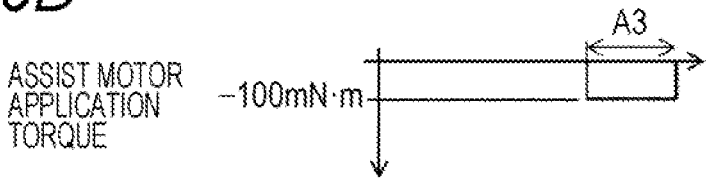

Therefore, torque assist by the assist motor 130 is performed in the deceleration section A3. For example, as illustrated in FIG. 10C, in the deceleration section A3, the torque of the main motors 111 and 112 is controlled to be 200 mN·m in the reverse direction. In this example, the torque of the assist motor 130 is controlled to be 100 mN·m in the reverse direction so that a sum of the torque of the assist motor 130 and the torque of the main motors 111 and 112 exceeds the torque necessary for stopping the conveying rollers 101 and 102.

As a result, no torque exceeding the maximum synchronizing torque is applied to the main motors 111 and 112 in the deceleration section A3, and step-out can be prevented of the main motors 111 and 112.

The present invention is applied to an image forming system including an apparatus that supplies a sheet to an image forming apparatus, and an apparatus that performs post-processing on a sheet on which an image is formed.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet conveying apparatus comprising:

a plurality of conveyors provided along a sheet conveying direction;

a plurality of main driving parts, each of which is respectively connected to a respective one of the plurality of conveyors to independently drive the conveyors to convey a sheet in the sheet conveying direction;

an auxiliary driving part that drives the plurality of conveyors to convey the sheet in the sheet conveying direction; and a transmitter that transmits driving force between the plurality of conveyors and transmits driving force of the auxiliary driving part to the plurality of conveyors.

2. The sheet conveying apparatus according to claim 1, wherein each of the main driving parts is either a stepping motor or a brushless motor, and the auxiliary driving part is either a brushless motor or a brushed motor.

3. The sheet conveying apparatus according to claim 1, further comprising a shut-off part that shuts off transmission of driving force between the plurality of conveyors.

4. The sheet conveying apparatus according to claim 3, wherein the shut-off part is provided to the transmitter and shuts off driving force transmitted from the auxiliary driving part to the conveyors.

5. The sheet conveying apparatus according to claim 1, further comprising a controller that controls presence or absence of driving of the auxiliary driving part and torque to be applied to the conveyors by the auxiliary driving part on the basis of control information used to control the main driving parts.

6. The sheet conveying apparatus according to claim 5, wherein the controller increases the torque to be applied to the conveyors by the auxiliary driving part with respect to the torque to be applied to the conveyors by the respective main driving parts on the basis of the control information for the main driving parts.

7. The sheet conveying apparatus according to claim 6, wherein the controller increases the torque to be applied to the conveyors by the auxiliary driving part with respect to the torque to be applied to the conveyors by the respective main driving parts, at timing for switching from an acceleration section for increasing a number of revolutions of the main driving parts to a constant speed section for making the number of revolutions of the main driving parts constant, on the basis of the control information for the main driving parts.

8. The sheet conveying apparatus according to claim 5, wherein the controller controls the torque to be applied to the conveyors by the auxiliary driving part in a deceleration section for stopping the main driving parts on the basis of the control information of the main driving parts.

9. An image forming apparatus comprising:

an image forming part that forms an image on a sheet; and the sheet conveying apparatus according to claim 1.

10. The sheet conveying apparatus according to claim 1, wherein a distance between two adjacent ones of the plurality of conveyors in the sheet conveying direction is less than a length of the sheet in the sheet conveying direction.

11. The sheet conveying apparatus according to claim 1, further comprising a controller configured to control the plurality of main driving parts and the auxiliary driving part;

wherein, during acceleration and deceleration, the controller controls the auxiliary driving part at a constant speed, and the controller controls the main driving parts for position control.

* * * * *